United States Patent [19]

Gardner et al.

[11] Patent Number: 4,850,056

[45] Date of Patent: Jul. 25, 1989

[54] ATHLETIC PANTS

[75] Inventors: James D. Gardner; Hal D. Mitchell; Paul F. Stickley; Alvin E. Taylor; Edward J. Wilson, all of Richmond, Va.

[73] Assignee: Figgie International, inc., Richmond, Va.

[21] Appl. No.: 77,638

[22] Filed: Jul. 24, 1987

[51] Int. Cl.[4] ..... A41D 1/08

[52] U.S. Cl. ..... 2/227; 2/228; 2/DIG. 4

[58] Field of Search ..... 2/227, 228, DIG. 4

[56] References Cited

U.S. PATENT DOCUMENTS

| | | | |
|---|---|---|---|
| D. 92,392 | 6/1934 | Dwyer | D2/42 |
| D. 282,212 | 1/1986 | Langmyr | D2/28 |
| 2,239,972 | 4/1941 | Rauser | 2/224 |
| 2,242,526 | 5/1941 | Kneibler | 2/224 |
| 2,306,514 | 12/1942 | Wilker et al. | 2/227 |
| 2,311,871 | 2/1943 | Riepen | 2/227 |
| 2,341,580 | 2/1944 | Trageser | 2/227 |
| 2,387,405 | 10/1945 | Neilson | 2/227 |
| 2,416,857 | 3/1947 | Trinkel | 2/227 X |
| 2,425,460 | 8/1947 | Davis | 2/227 |
| 2,462,508 | 2/1949 | Kneibler | 2/224 |
| 2,753,567 | 7/1956 | Brice | 2/227 |
| 3,996,622 | 12/1976 | Cooke | 2/227 |
| 4,261,060 | 4/1981 | Zawacki | 2/227 |

*Primary Examiner*—Joseph J. Hail, III

*Attorney, Agent, or Firm*—Senniger, Powers, Leavitt & Roedel

[57] ABSTRACT

A pair of athletic pants comprising a body portion including a waistband and a seat, and two legs depending from the body portion, wherein the seat comprises a plurality of panels shaped and assembled so that when a wearer of the pants assumes a crouched position the pants are adapted to closely conform to the buttocks of the wearer with the panels in a substantially unstressed condition. The seat comprises a center panel extending from the waist band to at least the crotch, and tapering from the waistband to the crotch. Two seat panels adapted to extend over the buttocks of the wearer are joined along their respective inside edges to the center panel. A leg panel extends downwardly from each seat panel and is adapted to cover at least a portion of the wearer's leg. The seat protrudes at the junction of the seat and leg panels to accommodate the buttocks of the wearer in a crouched position.

7 Claims, 3 Drawing Sheets

ATHLETIC PANTS

BACKGROUND OF THE INVENTION

This invention relates generally to athletic pants, and in particular to pants for football or other sports constructed to avoid stressing or stretching of the fabric of the pants when a player assumes a crouched position.

For many reasons including appearance, reduction of drag, support and protection, and at least in the case of football, to prevent opposing players from gaining a grip, some athletic pants are made to closely conform to the body. To allow movement, these pants are typically made from stretchable material. However, even in pants made from stretchable material it can be uncomfortable and fatiguing for a player to crouch. The resilience of the fabric, especially in the seat area, which is stretched the most when the player crouches, urges the player upright. Repetitive crouching against the resistance of the fabric of the pants during the course of a game tends to tire the player. Furthermore, as the player tires it becomes increasingly difficult to crouch and thus the player becomes less inclined to assume the proper playing position.

Another problem with close fitting athletic pants has been that they generally have not been constructed to facilitate or even accommodate flexing of the knees. Thus when a player wearing closely fitting athletic pants flexes his or her knees, it tends to dislocate the other portions of the pants relative to the wearer's leg, which can result in the dislocation of any protective pads incorporated into the pants.

Still another problem with close fitting athletic pants has been that they are not adapted for use with protective or supportive knee appliances. Such appliances are generally adapted to be worn on the lateral side of the knee for protection and support. It is desirable that the support be anchored and covered as much as possible by the pants to prevent the appliance from being dislocated. However, there has been no provision for either anchoring or covering such appliances.

SUMMARY OF THE INVENTION

Among the objects of the present invention is the provision of athletic pants which are constructed to closely conform to the body of the wearer but which are comfortable and less fatiguing to crouch in; the provision of such athletic pants constructed to closely conform to the seat of the wearer without substantial stressing or stretching of the fabric when the wearer is in a crouched position; the provision of such athletic pants which have knee areas of stretchable material to accommodate flexing of the wearer's knee with a minimum of effort and without substantial dislocation of the other areas of the pants relative to the wearer's legs; and the provision of such athletic pants which are adapated for use with knee appliances, such as knee protectors and braces.

Generally, the improved athletic pants of the present invention comprise an upper portion including a waistband and a seat, and two legs depending from the upper portion. According to the present invention the seat is formed from a plurality of panels shaped and assembled so that when the wearer is in a crouched position the pants are adapted to closely conform to the buttocks of the wearer with the panels in a substantially unstretched condition.

More particularly, the seat comprises a center panel extending from the waistband to at least the crotch, and having side edges tapering from the waistband to the crotch. A seat panel adapted to extend over the buttocks of the wearer is attached on either side of the center panel. Each seat panel comprises a top edge coextensive with the waistband, an outside edge joined to the side of the pants, a generally downwardly laterally sloping inside edge joined to a respective side of the center panel, and a convexly curved bottom edge. The bottom edges of the seat panels are longer than the top edges. A leg panel extends downwardly from each seat panel and is adapted to cover at least a portion of the wearer's leg. Each leg panel comprises a top edge joined to the bottom edge of one of the seat panels, an upper inside edge joined to the side of the center panel below the seat panel, and a lower inside edge and an outside edge joined to the portions of the pants forming the sides and fronts of the legs.

The radius of curvature of the convex bottom edge of the seat panels and the concave top edge of the leg panels differs to form a bulge at their juncture to accommodate the protruding buttocks of a player in a crouched position.

In a second aspect, the athletic pants of the present invention comprise a body portion and legs depending therefrom, each leg being adapted to extend from the body portion to below the wearer's knee. The front portion of each leg comprises an upper section of substantially inelastic material adapted to cover the wearer's leg above the knee, a lower section of substantially inelastic material adapted to cover at least a portion of the wearer's leg below the knee, and a middle section, attached at its upper end to said upper section and at its lower end to said lower section, the middle section being made of elastic material and being adapted to cover the wearer's knee. The middle section is stretchable to accommodate the flexing of the wearer's knee without substantial dislocation of the upper and lower portions of the pants' leg relative to the wearer's leg.

In a third aspect of the invention, the athletic pants of the present invention are adapted for use with knee appliances of the type comprising hingedly connected upper and lower members adapted to be positioned on the lateral side of each knee by means for securing the upper member to the leg above the knee and means for securing the lower member to the leg below the knee. Generally, the athletic pants comprise a body portion and legs depending from the body portion. Each pant leg is adapted to extend from the body portion of the pants to below the wearer's knee and has a front portion for covering the front of the wearer's leg, a back portion for covering the back of the wearer's leg, a medial side portion for covering the inner side of the wearer's leg and a lateral side portion for covering the outer side of the wearer's leg. The lateral side portion of each pants leg terminates in a bottom edge above its respective knee. A front flap on the front portion of the leg is adapted to extend rearwardly over the outside of the leg, and a rear flap on the back portion of the leg is adapted to extend forwardly over the outside of the leg. Attaching means are provided for releasably attaching the front and rear flaps in overlapping relation generally below the bottom edge of said lateral side portions of said pants leg thereby to form, in conjunction with said lateral side portion, a substantially continuous surface covering the outside of the leg of the wearer to a point below the knee of the wearer with an opening therein through which a portion of the appliance can extend.

In a fourth aspect of the invention, the athletic pants of the present invention are adapted for use with knee appliances of the type comprising hingedly connected upper and lower members adapted to be positioned on the lateral side of each knee by means for securing the upper member to the leg above the knee and by means for securing the lower member to the leg below the knee. The athletic pants comprise a body portion and legs depending from the body portion, and a flap attached on the inside of each pants leg in position to overlap the means for securing the upper member of the appliance. The flap is provided with engaging means for engaging mating engaging means on the securing means to releasably engage the knee appliance to the pants.

BRIEF DESCRIPTION OF THE DRAWINGS

Corresponding reference characters indicate corresponding parts throughout the several views of the drawings.

DETAILED DESCRIPTION OF THE PREFERRED EMBODIMENT

Figure 4:
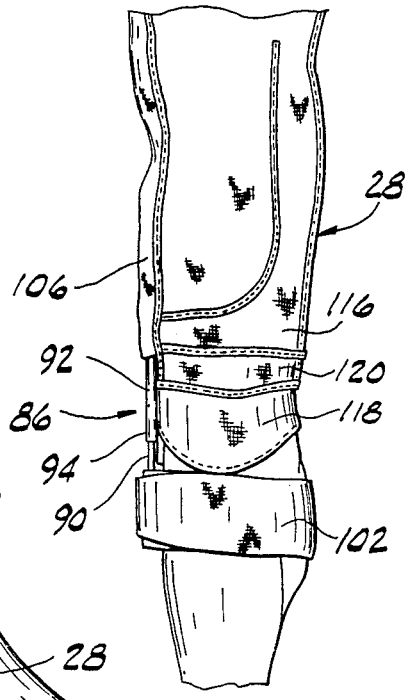
FIG. 4 is a partial front elevation of the right leg of the athletic pants shown on a player standing upright.
Figure 1:
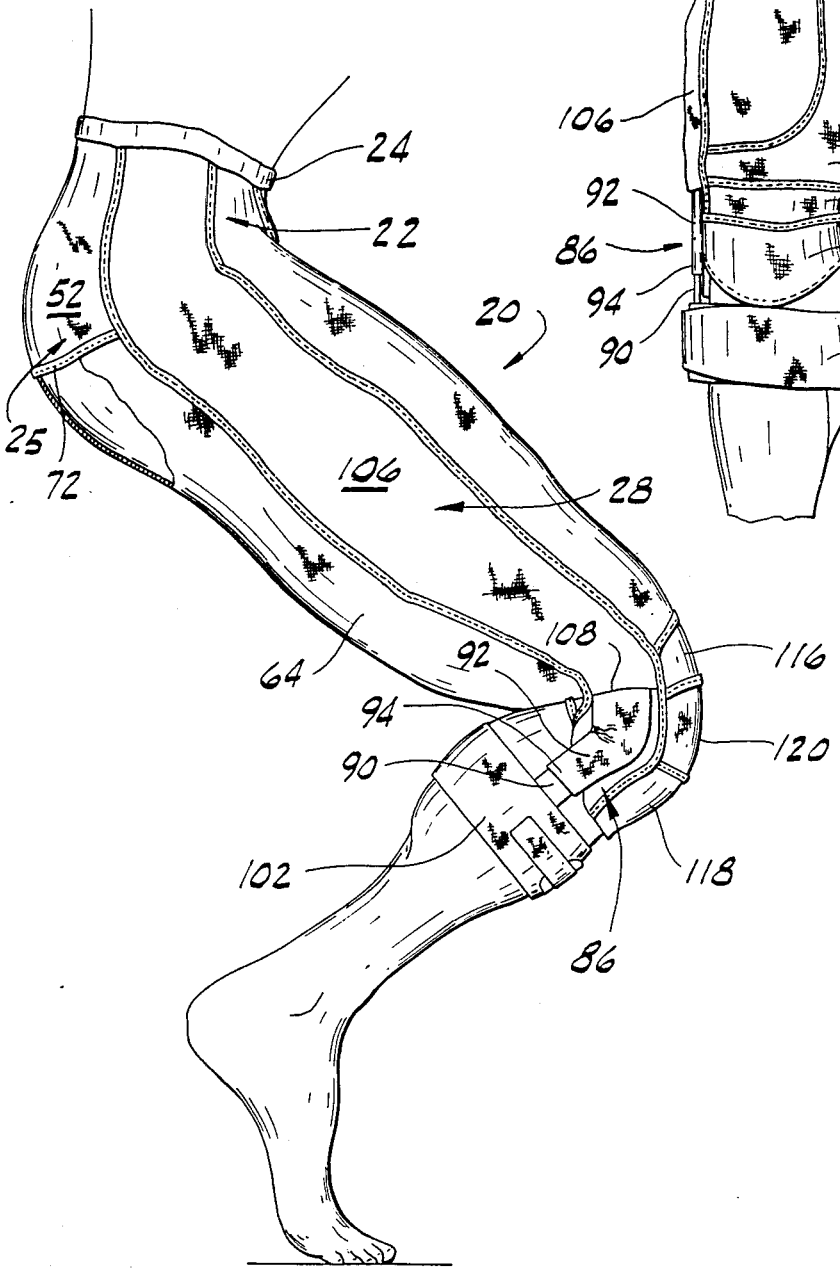
FIG. 1 is a right side elevation of athletic pants constructed according to the principles of this invention shown on a player in a crouched position.
Figure 3:
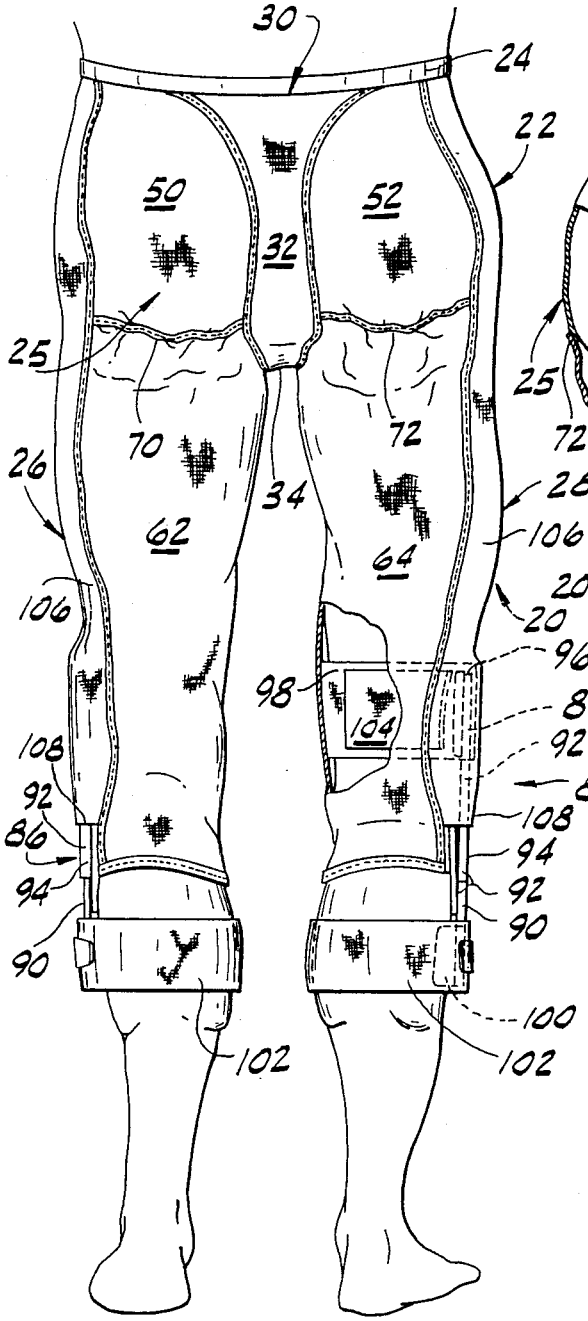
FIG. 3 is a rear elevation of the athletic pants shown on a player standing upright.
Figure 2:
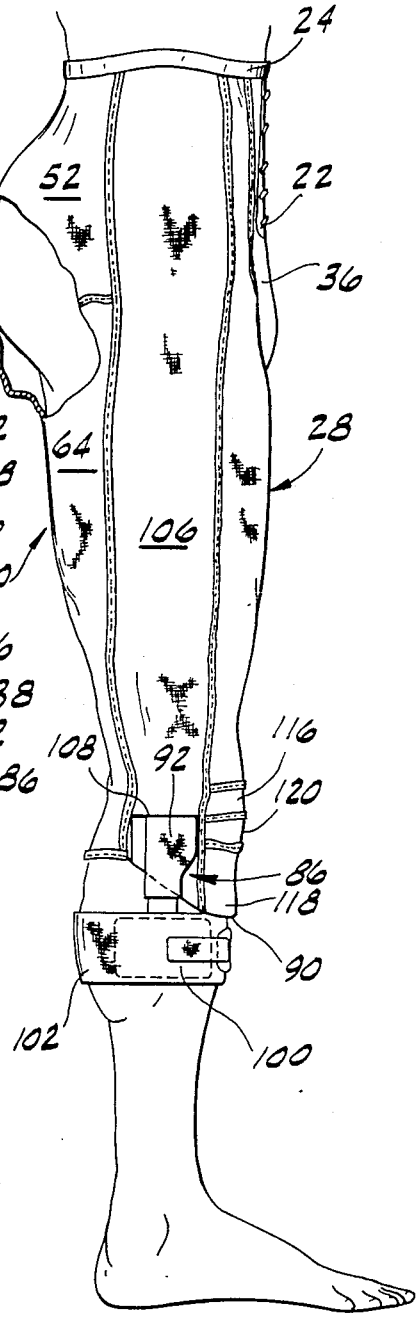
FIG. 2 is a right side elevation of the athletic pants shown on a player standing upright.

A pair of athletic pants constructed according to the principles of this invention, indicated generally as 20 in FIGS. 1, 2, and 3, is shown in FIG. 1 on a player in a crouched position. As shown in the Figures and described herein the athletic pants are football pants, although it will be understood that the present invention is not so limited.

Football pants 20 includes a body portion 22 having a waistband 24 at the to, a seat 25, and left and right legs 26 and 28 depending from the body portion. According to the present invention, seat 25 has a multi-panel construction in which the panels are shaped and assembled to closely conform in a substantially unstressed condition to the seat or buttocks of the wearer when the wearer is in a crouched position, such as that required in playing football. In the preferred embodiment there are five panels, each of which is made from a stretchable material.

Figure 6:
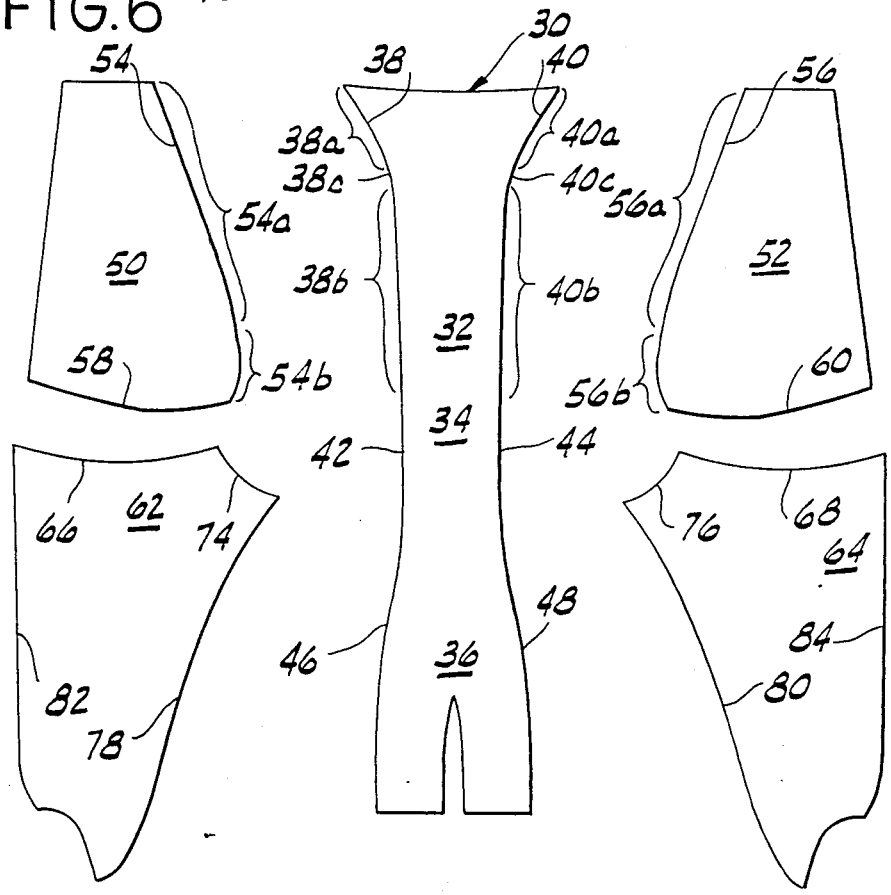
FIG. 6 is a schematic of the separate panels forming the seat construction of the athletic pants of the present invention.

As best shown in FIG. 6, the seat construction comprises an elongate center panel 30 which is generally symmetric about the longitudinal axis of the panel. The center panel 30 extends from the waistband 24 to at least the crotch of the pants, and preferably past the crotch and up the front of the pants, and thus has rear, crotch, and front sections designated 32, 34, and 36, respectively. The side edges 38 and 40 of the rear section 32 comprise generally straight upper reaches **38*a* and 40*a* which taper relatively sharply inwardly and downwardly from the waistband, relatively longer, generally straight lower reaches 38*b* and 40*b* which taper relatively less sharply inwardly and downwardly to the crotch section 34, and curved transition reaches 38*c* and 40*c*. The side edges 42 and 44 of the crotch section 34 are generally parallel. The side edges 46 and 48 of the front panel taper inwardly and downwardly from the waistband to the crotch section, although less sharply than the upper reaches 38*a* and 40*a*** of the rear section.

The seat construction further comprises left and right seat panels 50 and 52, respectively, each seat panel being a substantial mirror image of the other. The seat panels 50 and 52 are joined along their inside edges 54 and 56, respectively, to the side edges 38 and 40 of the rear section of the center panel 30. The inside edges 54 and 56 of the two seat panels slope laterally outwardly with respect to the panels and comprise upper reaches **54*a* and 56*a* sloping outwardly in a generally straight line, and relatively shorter, generally convexly curved lower reaches 54*b* and 56*b*. The upper reaches 54*a*, 56*a* of the inside edges of the seat panels are longer than the respective upper reaches 38*a*, 40*a* of the rear section of the center panel 30. The junctures between the upper reaches 54*a*, 56*a* of the seat panels 50, 52 and the respective upper, lower, and transition reaches 38*a*, 40*a*, 38*b*, 40*b*, 38*c*, 40*c*, of the rear portion of center panel 30 are such as to cause the center panel and the seat panels to assume a generally concave configuration immediately below the waistband so as to conform to the contour of the lower back of the wearer in a crouched position. The juncture between the lower reaches 54*b*, 56*b* of the seat panels 50, 52 and the respective lower reaches 38*b*, 40*b* of the center panel 30 are such as to cause the center panel and seat panels to assume a generally convex configuration to accommodate the protruding buttocks of the wearer in a crouched position. The bottom edges 58 and 60**, respectively, of each seat panel are convexly curved.

The seat construction further comprises left and right leg panels indicated at 62 and 64, respectively, each leg panel being the mirror image of the other. The leg panels 62, 64 are joined along their top edges 66, 68 to respective bottom edges 58, 60 of the seat panels 50, 52. The top edges 66, 68 of leg panels 62, 64 are concave, and have a larger radius of curvature than the convex bottom edges 58, 60 of the seat panels to which they are joined, forming a protuberance or bulge along the junctures 70, 72 of the respective pairs of seat and leg panels, with the seat panels and the leg panels extending generally forwardly therefrom. The leg panels 62, 64 also have concave upper inside edges 74 and 76, respectively, joined to edges 38 and 40 of the rear section of the center panel 30 below the seat panels, lower inside edges 78 and 80, respectively, and outside edges 82 and 84, respectively, joined to the portions forming the sides and fronts of the legs.

The football pants 20 are adapted to be used with a hinged knee appliance, indicated generally as 86 in the Figures. The knee appliance 86 is preferably any one of those well known in the art adapted to be worn on the lateral side of the knee for protection and/or support. The brace 86 comprises an upper member 88 and a lower member 90 hingedly connected at 92. The hinged joint 92 is preferably covered with a protective cover 94. The upper end of the upper member 88 has a thigh plate 96 for engaging the thigh of the wearer. The upper member is secured to the wearer's leg by a thigh band 98 that extends around the thigh and over the thigh plate 96 and is secured as with a hook-and-loop type fastening material of the type sold under the trademark "Velcro". The lower end of the lower member 90 has a calf plate 100 engaging the calf of the wearer. The lower member is secured to the wearer's leg by a calf band 102 that extends around the calf and over the calf plate 100 and is secured as with a hook-and-loop type fastening material of the type described above.

To anchor the appliance 86, a flap 104 is preferably provided inside the legs 26, 28 of the pants, as best shown in FIG. 3. The flap 104 extends around the back of the inside of the leg and is preferably secured along at least one edge (e.g., a side edge) to the pants 20 as by stitching. The flap 104 is releasably engageable with the thigh band 98 to secure the appliance 86 to the pants 20. To accomplish this, the inner exposed face of the flap 104 and the outer face of the thigh band 98 have mating engaging means thereon, such as complementary hook-and-loop type fastening elements which are releasably engageable with one another.

Figure 5:
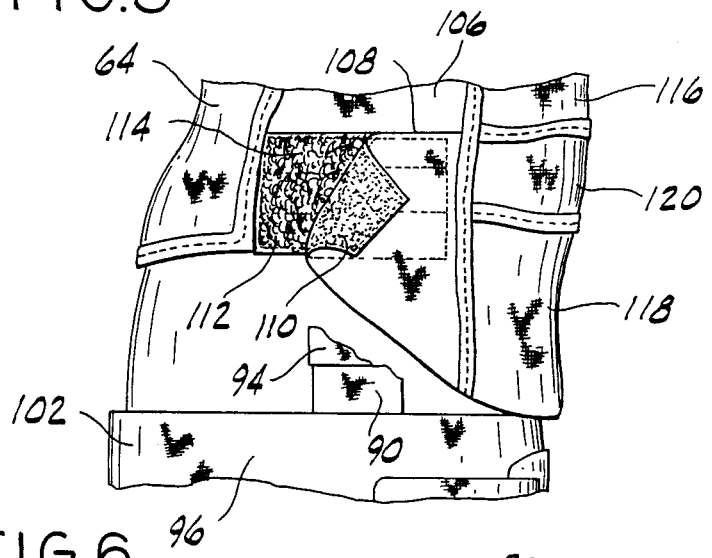
FIG. 5 is an enlarged side elevation of the lower portion of the right pants leg illustrating the manner in which a knee appliance is used with the pants of this invention, parts of the knee appliance being broken away for clarification.

As shown in the drawings, each leg 26, 28 of football pants 20 is preferably adapted to extend from the body portion 22 of the pants to below the wearer's knee. Each pants leg comprises a front portion for covering the front of the wearer's leg, a back portion for covering the back of the wearer's leg, a medial side portion for covering the inner side of the wearer's leg, and a lateral side portion 106 for covering the outer side of the wearer's leg. To accommodate the appliance 86, the lateral side portions 106 of the legs terminate at a bottom edge 108 disposed above the bottom edges of the front and back portions of the pants legs. As shown best in FIG. 5, the front portion has a front flap 110 adapted to extend rearwardly over the outside of the leg and the rear portion has a rear flap 112 adapted to extend forwardly over the outside of the leg. Flaps 110 and 112 have means such as complimentary hook-and-loop type fastening elements for releasably attaching the flaps in overlapping relation generally below the bottom edge 108 of the lateral side portion of the leg. The flaps form, in conjunction with the the lateral side portion 106, a substantially continuous surface covering the outside of the leg of the wearer to a point generally below the knee of the wearer. This substantially continuous surface has an opening in the form of a slit 114 thereon defined by the space between lower edge 108 of the pants leg and the upper edges of the flaps 110, 112 for receiving a portion of the knee appliance 86 (the upper member 88 as illustrated in the drawings).

The front portion of each pants leg comprises a front upper section 116 of a substantially inelastic material adapted to cover the leg above the knee, a front lower section 118 also of a substantially inelastic material adapted to cover at least a portion of the leg below the knee, and a middle section 120, attached at its upper end to upper section 116 and at its lower end to lower section 118, of elastic material (e.g., stretch nylon fabric) adapted to cover the knee. The middle section 120 is stretchable to accommodate the flexing of the wearer's knee without substantial dislocation of the upper and lower portions of the pants leg relative to the wearer's leg. As best shown in FIG. 1, the middle section 120 facilitates flexing of the knee and permits longitudinal lengthening of the front portion to accomodate the lengthening of the front of the wearer's leg upon flexing of the knee to prevent dislocation of the upper and lower sections 116, 118 relative to the wearer's leg. This prevents dislocation of the various protective pads incorporated into the pants. As shown in the figures, the front flap 110 extends rearwardly from the lower and middle sections 118, 120 of the front portion of the pants.

In view of the above, it will be seen that the several objects of the invention are achieved and other advantageous results attained.

As various changes could be made in the above constructions without departing from the scope of the invention, it is intended that all matter contained in the above description or shown in the accompanying drawings shall be interpreted as illustrative and not in a limiting sense.

What is claimed is:

1. In a pair of athletic pants comprising an upper portion including a waistband and seat, and two legs depending from the upper portion, the improvement comprising a plurality of panels forming the seat shaped and assembled so that when a wearer of the pants assumes a crouched position the pants are adapted to closely conform to the buttocks of the wearer with the panels in a substantially unstressed condition, the plurality of panels comprising a center panel extending from the waistband to at least the crotch and having side edges tapering from the waistband to the crotch, two seat panels on opposite sides of the center panel, each seat panel having a side edge joined to a respective side of the center panel, and a bottom edge, and two leg panels each having a top edge joined to the bottom edge of one of the seat panels and a side edge joined to a respective side edge of the center panel below the seat panel, excess material being provided to form a bulge in the pants at the junction of the seat and leg panels for accommodating the buttocks of the wearer in a crouched position.

2. In a pair of athletic pants comprising an upper portion including a waistband and seat, and two legs depending from the upper portion, the improvement comprising a plurality of panels forming the seat shaped and assembled so that when a wearer of the pants assumes a crouched position the pants are adapted to closely conform to the buttocks of the wearer with the panels in a substantially unstressed condition, the plurality of panels comprising a center panel extending from the waistband to at least the crotch and having side edges tapering from the waistband to the crotch, two seat panels on opposite sides of the center panel, each seat panel having a side edge joined to a respective side of the center panel, and a bottom edge, and two leg panels each having a top edge joined to the bottom edge of one of the seat panels and a side edge joined to a respective side edge of the center panel below the seat panel, the bottom edges of the seat panels being convexly curved.

3. The athletic pants according to claim 2 wherein the top edges of the leg panels are concavely curved, and wherein the radius of curvature of the concave top edges of the leg panels is greater, than the radius of curvature of the convex bottom edges of the seat panels, the seat and leg panels forming a bulge at their juncture to accommodate the buttocks of the wearer in a crouched position.

4. A pair athletic pants of the type comprising an upper portion including a waistband and a seat, and two legs depending from the upper portion, the improvement comprising constructing the seat from a plurality of panels shaped and assembled so that when a wearer of the pants assumes a crouched position the pants are adapted to closely conform to the buttocks of the wearer with the panels in a substantially unstressed condition, said seat construction comprising:

a center panel extending from the waistband to at least the crotch, the center panel having side edges tapering from the waistband to the crotch;

two seat panels adapted to extend over the buttocks of the wearer, each seat panel having a top edge coextensive with a portion of the waistband, an outside edge joined to portions of the pants forming the sides and front of the pants, a generally downwardly laterally sloping inside edge joined to a respective side of the center panel, and a convexly curved bottom edge, the bottom edges of the seat panels being longer than the top edges;

two leg panels each extending downwardly from one of the seat panels and covering at least a portion of the wearer's leg, each leg panel having a top edge joined to the bottom edge of one of the seat panels, an upper inside edge joined to the side of the center panel below the seat panel, a lower inside edge, and an outside edge joined to portions of the pants forming the sides and fronts of the legs.

5. The athletic pants according to claim 4, wherein the top edge of each leg panel is concave and has a larger radius of curvature than the convex bottom edge of the respective seat panel thereby to form a bulge in the pants to accommodate the buttocks of the wearer in a crouched position.

6. A seat construction for a pair of athletic pants of the type comprising an upper portion including a waistband and a seat, and two legs depending from the upper portion, the improvement comprising constructing the seat from a plurality of panels shaped and assembled so that when a wearer of the pants assumes a crouched position the pants are adapted to closely conform to the buttocks of the wearer with the panels in a substantially unstressed condition, said seat construction comprising:

an elongate center panel generally symmetric about the longitudinal axis of the panel having a rear section extending down from the waistband and a crotch section, said rear section having opposite side edges comprising upper reaches tapering sharply downwardly and inwardly from the waistband and lower reaches extending down to the crotch section;

left and right seat panels, each seat panel being a substantial mirror image of the other, joined along their respective inside edges to the center panel, the inside edge of each seat panel sloping generally laterally outwardly from the upper edge of the seat panel and comprising a substantially straight upper reach and a relatively shorter lower reach generally convexly curved with respect to the seat panel, the upper reach of the inside edge of each seat panel being longer than the upper reach of a respective side edge of the rear section of the center panel, each seat panel further having a generally convexly curved bottom edge;

left and right leg panels, each leg panel being a substantial mirror image of the other, joined along their respective top edges to the bottom edges of respective seat panels, each leg panel having a concave top edge with a greater radius of curvature than the convex bottom edge of the seat panel it is joined to, thereby forming a bulge along the juncture of the seat and leg panels, with the leg panels disposed generally forwardly of the bulge, the leg panels further having an upper inside edge joined to a respective side of the center panel below the seat panel, a lower inside edge and an outside edge joined to portions forming the sides and fronts of the legs.

7. In seat construction for a pair of athletic pants of the type comprising an upper portion including a waistband and a seat, and two legs depending from the upper portion, the improvement comprising constructing the seat from a plurality of panels shaped and assembled so that when the wearer of the pants assumes a crouched position the pants are adapted to closely conform to the protruding buttocks, forwardly extending upwardly curving back, and forwardly extending legs of the wearer with the panels in a substantially unstressed condition, said seat construction comprising:

an elongate center panel generally symmetric about the longitudinal axis of the panel having a rear section extending down from the waistband and a crotch section, said rear section having opposite side edges comprising upper reaches tapering sharply downwardly and inwardly from the waistband and lower reaches extending down to the crotch section;

left and right seat panels, each seat panel being a substantial mirror image of the other, joined along their respective inside edges to the center panel, the inside edge of each seat panel sloping generally laterally outwardly from the upper edge of the seat panel and comprising a substantially straight upper reach and a relatively shorter lower reach generally convexly curved with respect to the seat panel, the upper reach of the inside edge of each seat panel being longer than the upper reach of a respective side edge of the rear section of the center panel, the juncture between the upper reach of the inside edge of each seat panel and the upper reach of a respective side edge of the rear section of the center panel being such as to cause the center panel and the seat panels to assume a generally concave configuration immediately below the waistband so as to conform to the contour of the lower back of the wearer in a crouched position, and the juncture between the lower reach of the inside edge of each seat panel and the respective side edge of the center panel being such as to cause the center panel and seat panels to assume a generally convex configuration to accommodate the protruding buttocks of the wearer in a crouched position, each seat panel further having a generally convexly curved bottom edge;

left and right leg panels, each leg panel being a substantial mirror image of the other, joined along their respective top edges to the bottom edges of respective seat panels, each leg panel having a concave top edge with a greater radius of curvature than the convex bottom edge of the seat panel it is joined to, thereby forming a bulge along the juncture of the seat and leg panels, with the leg panels disposed generally forwardly of the bulge, the leg panels further having an upper inside edge joined to a respective side of the center panel below the seat panel, a lower inside edge and an outside edge joined to portions forming the sides and fronts of the legs.

* * * * *